US009084915B2

(12) United States Patent
Philip

(10) Patent No.: US 9,084,915 B2
(45) Date of Patent: Jul. 21, 2015

(54) DEVICE FOR STRENGTHENING PELVIC FLOOR MUSCULATURE IN WOMEN

(71) Applicant: Peter A Philip, New Canaan, CT (US)

(72) Inventor: Peter A Philip, New Canaan, CT (US)

( * ) Notice: Subject to any disclaimer, the term of this patent is extended or adjusted under 35 U.S.C. 154(b) by 182 days.

(21) Appl. No.: 14/052,322

(22) Filed: Oct. 11, 2013

(65) Prior Publication Data

US 2014/0106945 A1 Apr. 17, 2014

Related U.S. Application Data

(60) Provisional application No. 61/712,291, filed on Oct. 11, 2012.

(51) Int. Cl.

| | |
|---|---|
| ***A63B 21/02*** | (2006.01) |
| ***A63B 21/05*** | (2006.01) |
| ***A63B 71/00*** | (2006.01) |
| ***A63B 23/20*** | (2006.01) |
| ***A63B 21/00*** | (2006.01) |
| ***A63B 21/04*** | (2006.01) |

(52) U.S. Cl.

CPC ..... *A63B 23/20* (2013.01); *A63B 21/0004* (2013.01); *A63B 21/02* (2013.01); *A63B 21/023* (2013.01); *A63B 21/0421* (2013.01); *A63B 21/05* (2013.01); *A63B 21/00061* (2013.01); *A63B 21/00069* (2013.01)

(58) Field of Classification Search

CPC ..... A63B 21/00185; A63B 21/023; A63B 21/025; A63B 21/026; A63B 21/0421; A63B 21/05; A63B 21/1403; A63B 21/1419; A63B 21/1446; A63B 21/1449; A63B 21/1476; A63B 21/1492; A63B 2021/022; A63B 23/032; A63B 23/20

See application file for complete search history.

(56) References Cited

U.S. PATENT DOCUMENTS

| | | | | |
|---|---|---|---|---|
| 1,928,893 | A * | 10/1933 | Hoard | 606/197 |
| 5,865,715 | A * | 2/1999 | Wallick | 482/124 |
| 6,224,525 | B1 * | 5/2001 | Stein | 482/148 |
| 6,258,015 | B1 * | 7/2001 | Blackford et al. | 482/124 |
| 6,663,545 | B2 * | 12/2003 | Wilson | 482/139 |
| 6,733,425 | B2 * | 5/2004 | Blackford et al. | 482/112 |
| 8,118,726 | B1 * | 2/2012 | Blackford | 600/29 |
| 2002/0147082 | A1 * | 10/2002 | Harding-Randle | 482/128 |

* cited by examiner

*Primary Examiner* — Oren Ginsberg
(74) *Attorney, Agent, or Firm* — Carla Gannon Law

(57) ABSTRACT

A hinged vaginal strengthening device has three points of resistance along its length, which correspond with the three layers of pelvic musculature. The device is inserted into a vagina and compressed by the pelvic floor musculature, in accordance with various regimens to achieve goals such as decreasing vaginal gap or overcoming painful intercourse. The device is of various dimensions, thereby allowing a user to progress through multiple steps to achieve their goal of increasing or decreasing their vaginal space, as well as increasing muscle tone.

15 Claims, 8 Drawing Sheets

FIG. 8 – PRIOR ART

DEVICE FOR STRENGTHENING PELVIC FLOOR MUSCULATURE IN WOMEN

CROSS-REFERENCE TO RELATED APPLICATIONS

This application claims the benefit of U.S. Provisional Application 61/712,291, which was filed on Oct. 11, 2012.

BACKGROUND OF THE INVENTION

The present invention relates to exercise equipment, and more specifically, to a device and method for strengthening, and enhancing the functionality, of the pelvic floor musculature in women.

Weakness and dysfunction of the pelvic floor musculature in women is a common occurrence, and can be attributed to a variety of reasons including pregnancy and birth, the natural ageing process, disease, and disuse. Weaknesses and dysfunction can be a source of medical and personal issues that may affect a woman's quality of life due to back pain, bowel and bladder dysfunction, pain with intimacy, and/or weak to nonexistent orgasms.

Kegel Exercises have been used for decades as a means of strengthening these muscles. However, these exercises are often performed in a fashion that does not accurately recruit the desired musculature. Often the musculature is globally contracting, allowing the stronger musculature to override the weaker musculature, thus perpetuating asymmetry and progressive dysfunctions. Common errors include, but are not limited to the utilization of the respiratory diaphragm, gluteals, groin, and/or abdomen in lieu of the pelvic floor musculature. Many women have a difficult time isolating these muscles, thus making strengthening and/or coordinating them difficult or impossible. Even when a woman can isolate the pelvic floor musculature, she often has a difficult time utilizing them in a weight bearing, or functional fashion, which is why it is common for women to complain of persistent back pain with activity, and loss of urine during activities and coughing/laughing.

Other devices focus on a vertical closure, also known as flat closure, of the pelvic floor musculature. Because the vaginal canal and rectum are cylindrical, or ovoid, that require a narrowing of their lumen to provide their stability, flat closure doesn't allow for optimal stabilization and closure. In fact, flat closure limits the stability by nearly 66%. Thus, devices that facilitate vertical closure are not optimal.

Other devices facilitate evacuation, or pushing outwards, of the vagina. They are angled in such a fashion that the apex (narrow aspect) of the devices are the most internal, and the base of the device (widest aspect) are the most external. This promotes an outward pushing movement in lieu of an upward and inward contraction that will stabilize the pelvis, spine and urogenital structures, including the bladder, the uterus and the rectum. Furthermore, these devices put pressure on the bladder and urethra, leading to irritation and pain.

As can be seen, there is a need for a device that addresses the natural, and dynamic nature of the pelvic floor musculature, promoting both the horizontal and vertical vaginal closure alike without causing bladder and/or urethral irritation. It is desirable that this device is customizable, and that the resistance points and overall dimensions of this device are adjustable, allowing for the customization based on a user's unique needs, characteristics and anatomy. It is desirable that this device allows for the strengthening of the three distinct musculature layers of the pelvic floor, without allowing for the "stronger" muscles to "overpower" and inhibit activation of the weakened muscle segments. It is desirable that this invention is appropriate for both medical and general consumption, including post-surgical, non-surgical, continent, incontinent, pain-suffering, pain free, fit and de-conditioned users alike.

SUMMARY OF THE INVENTION

A device and method of strengthening pelvic floor musculature in women includes an elongated device having two semi-round arms that are longitudinally aligned with resilient members between. The semi-round arms are connected at a hinged joint to a handle having two semi-round sections.

In use, the device is inserted into a vagina, and force is exerted on the arms, thereby compressing the resilient members and bringing the arms closer together along their longitudinal axes. Repeated use of this device, by contracting and relaxing the associated musculature, increases pelvic floor health.

The diameter of the device is selected according to the therapeutic goal. In one embodiment each device has one diameter, and multiple devices, of either increasing or decreasing diameter, are used sequentially in a therapeutic regimen. In another embodiment arms having different diameters are interchanged in order to achieve different diameters. In yet another embodiment, sleeves having different diameters are used over the arms, thereby changing the overall girth of the device.

The resilient members of the device are also adjustable, or interchangeable.

DETAILED DESCRIPTION OF THE INVENTION

The following detailed description discusses the best currently contemplated modes of carrying out exemplary embodiments of the invention. The description is not to be taken in a limiting sense, but is made merely for the purpose of illustrating the general principles of the invention, since the scope of the invention is best defined by the appended claims.

The following structure numbers apply among the various FIGS.:

10—Strengthening device;

12—Arm;

14—Handle;

16—Hinge;

18—Sleeve;

20—Resistance axis; and

22—Guide rod.

Figure 1:
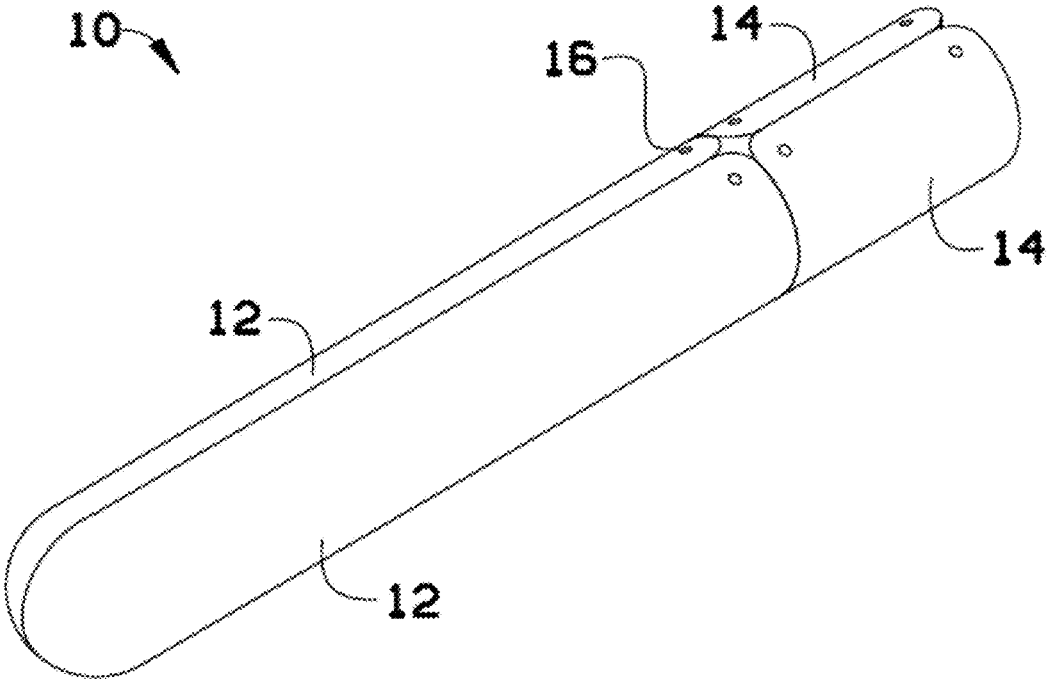
FIG. 1 is a perspective view of an embodiment of the invention.
Figure 2:
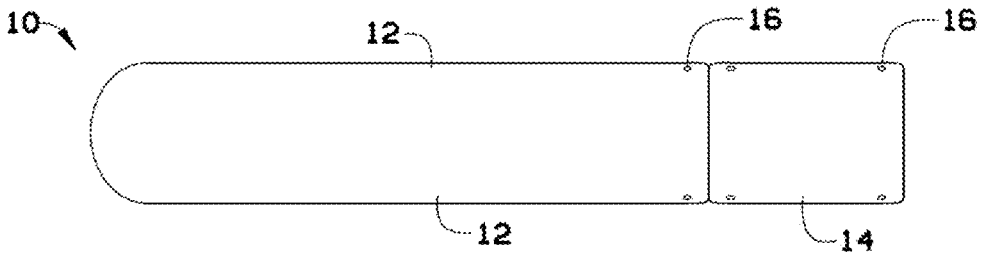
FIG. 2 is a side view of an embodiment.
Figure 3:
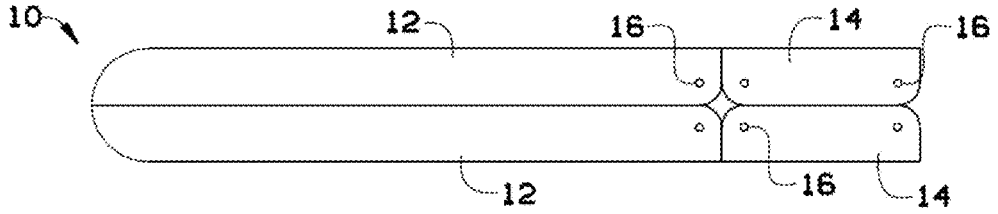
FIG. 3 is a top view of an embodiment.

Referring to FIGS. 1 and 2, strengthening device 10 in the compressed position is generally elongated with a cylindrical or ovoid cross-section having a rounded head, two semi-cylindrical or semi-ovoidal (collectively "semi-round") arms 12, and two semi-cylindrical or semi-ovoidal handles 14, separated by hinges 16. Device 10 can be used in accordance with methods set forth herein, or it may be used in another manner in order to maintain or develop pelvic health.

Figure 11:
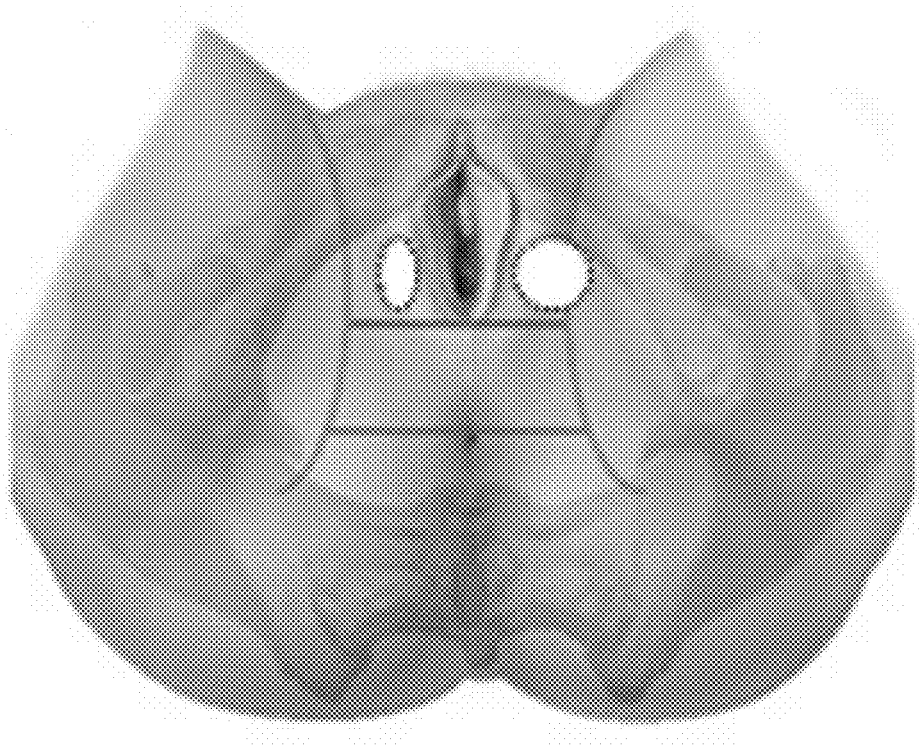
FIG. 11 is a view of a vaginal orifice.

As shown in FIG. 11, the vagina is ovoid in shape. Similarly, the present invention is preferably ovoid. It is desirable that the diameter (average between longest and shortest diameters of oval) of compressed arm 12 is a variety of different diameters, corresponding with different "levels", preferably levels 1-4. It is desirable that the lowest level, level 1, has a diameter of approximately 2 centimeters, the highest level, level 4, has a diameter of approximately 5.5 centimeters, and the mid-levels have diameters there between. The various levels (diameters) accommodate the ranges in sizes and shapes of vaginal orifices due to genetics, trauma, birthing or other factors.

The variability of the diameter can be accomplished in a variety of ways, all of which are within the scope of this invention. In one embodiment arms 12 are sized differently. In other words one device 10 is scaled for level 1, another device is scaled for level 2, and so forth. In practicing methods of this invention the user would employ multiple devices, probably levels 1-4, one device at a time, as they progress through a given program.

In another embodiment, arms 12 are detachable from handles 14, and different sized arms 12 are used in accordance with the desired level. In other words a user would employ one set of handles 14, and interchange multiple sets of arms 12, probably levels 1-4, one set of arms at a time, as they progress through a given program.

Figure 5:
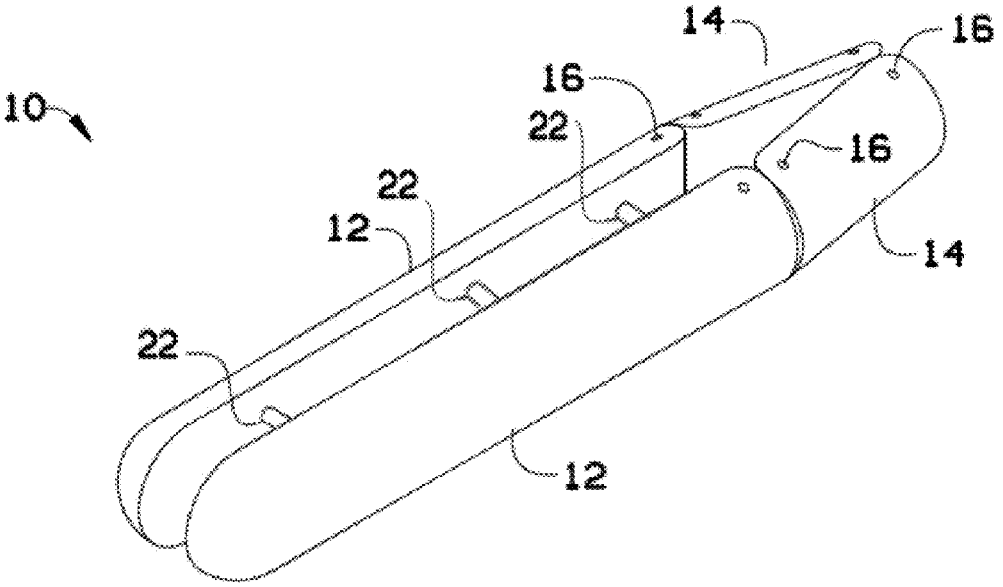
FIG. 5 is a perspective view of an embodiment in an expanded position.
Figure 6:
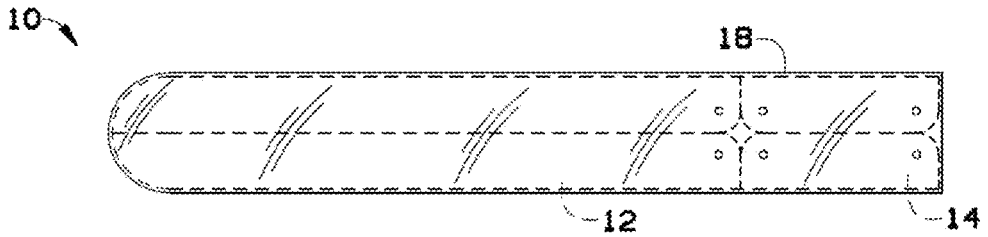
FIG. 6 is a top view of an embodiment including optional sleeve.

In yet another embodiment, sleeves 18 of various thicknesses are used to add girth to arm 12. In other words, one device 10 is used, and different level sleeves 18 are interchanged, one sleeve at a time, as a user progresses through a given program. One sleeve size is depicted in FIG. 5.

Even if sleeve 18 isn't employed to add girth to arms 12, a thin version of sleeve 18 may provide additional comfort for some users, and/or be desired for hygienic reasons. Sleeves, whether for girth or comfort/hygiene, may be constructed of silicone or other material that optimizes patient comfort.

Figure 10:
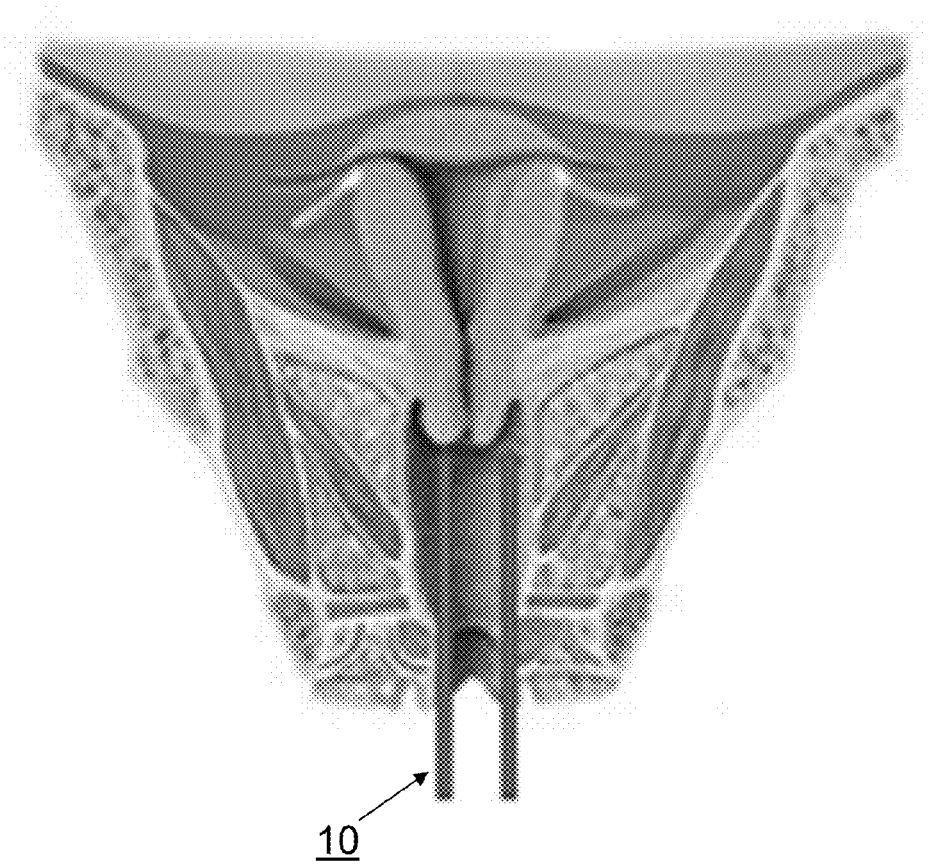
FIG. 10 is a view of a pelvic cavity depicting placement of the device inside a vagina.

In use, the device is longitudinally compressed and inserted, rounded head first, into the vagina. The proper position is depicted in FIG. 10. Upon releasing the device within the vagina, the device goes from compressed (FIG. 1) to expanded (FIG. 5) due to the outward force of the resilient members. The woman then performs contractions, thereby bringing arms 12 together to the compressed position, along the longitudinal axis, possibly in parallel, and subsequently releasing the forces so device returns to expanded position. The contraction can be held for a variety of durations. These exercises are preferably performed in a progressive strengthening regimen that includes both static and dynamic movements thereby allowing for greater carryover into functional activities.

The device can be used to overcome vaginal gapping, which is the degree to which the woman has difficulty in achieving vaginal closure, and to provide stability to the pelvis. Vaginal gapping is a factor that increases the likelihood of prolapsing, incontinence, lower back pain, and decreased to nonexistent orgasmic potential. In one embodiment of the invention a woman may use the device in a method that lessens vaginal gapping. In this method, the proper level, which corresponds with arm diameter, is selected, based on the size of the user's vaginal orifice. Typically this would be a level 4 or 3. The user initiates therapy by performing specific exercises (specific repetitions of contract, hold, release for specific time increments) using various resistance, over a specific period, typically six weeks to six months. After the specified time the user is evaluated, or self-evaluates, for improvement in the desired area. Such evaluation may be assessment of back pain and mobility, support of the viscera, enhancement of orgasm, sensations during vaginal penetration, and so forth. After establishing successful completion of the current level, the woman then substitutes the next lower level. Using the next lower level she performs the specific exercises over a specific period, then reassesses for suitability of progressing to the next level. The goal is to reach level 1 over a period of time. In this manner, vaginal gapping decreases.

Another method, basically the reverse, may be employed with women who suffer from dyspareunia, or painful intercourse. In this method, the woman would initiate the program using device 10 at the appropriate level, probably 1 or 2, based on the size of her vaginal orifice. After performing the specified regimen, the user is evaluated or self-evaluates for improvement. If acceptable improvement is achieved, she progresses to the next higher level. The goal is to reach level 4 over a period of time. In this manner the vagina is trained to comfortably accept a penis during intercourse.

Figure 4:
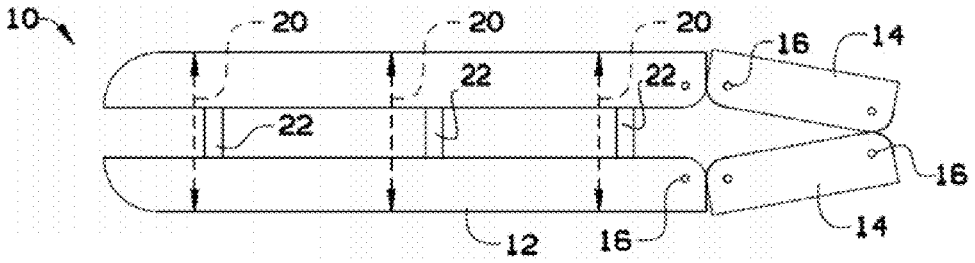
FIG. 4 is a top view of an embodiment in an expanded position.
Figure 7:
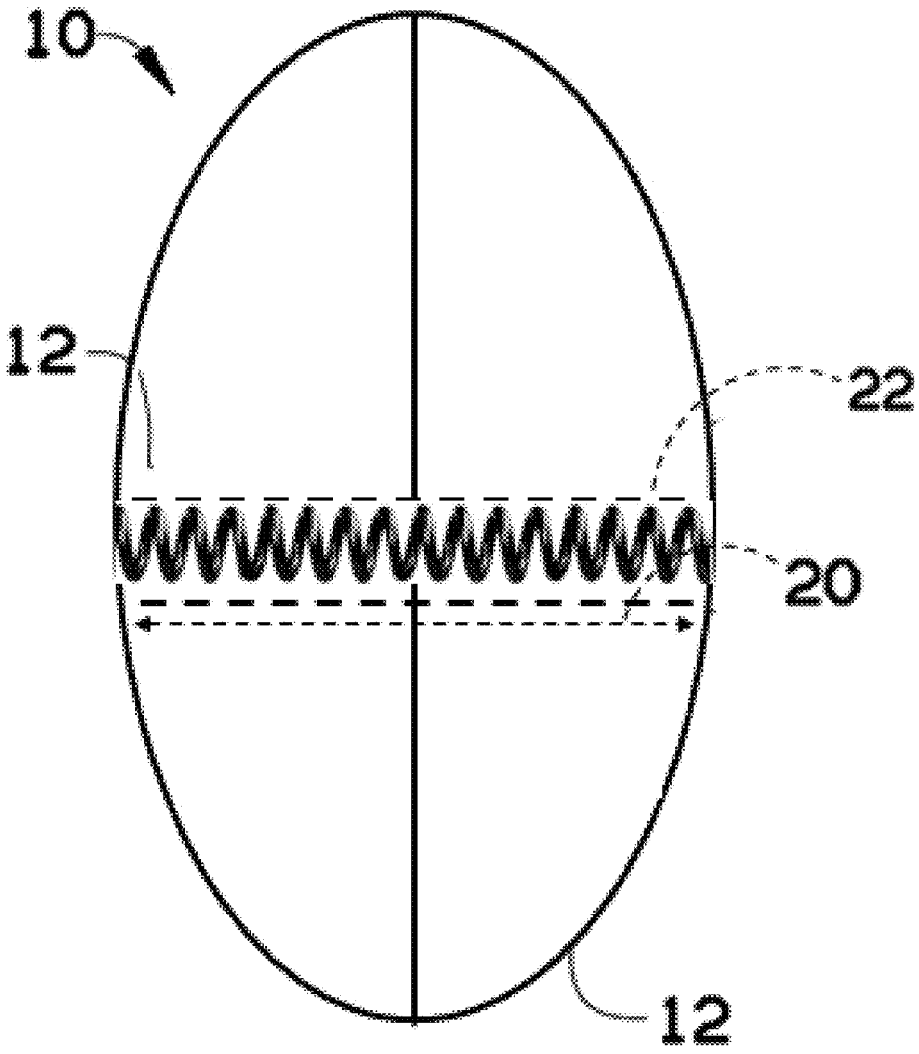
FIG. 7 is a front view of an embodiment.
Figure 8:
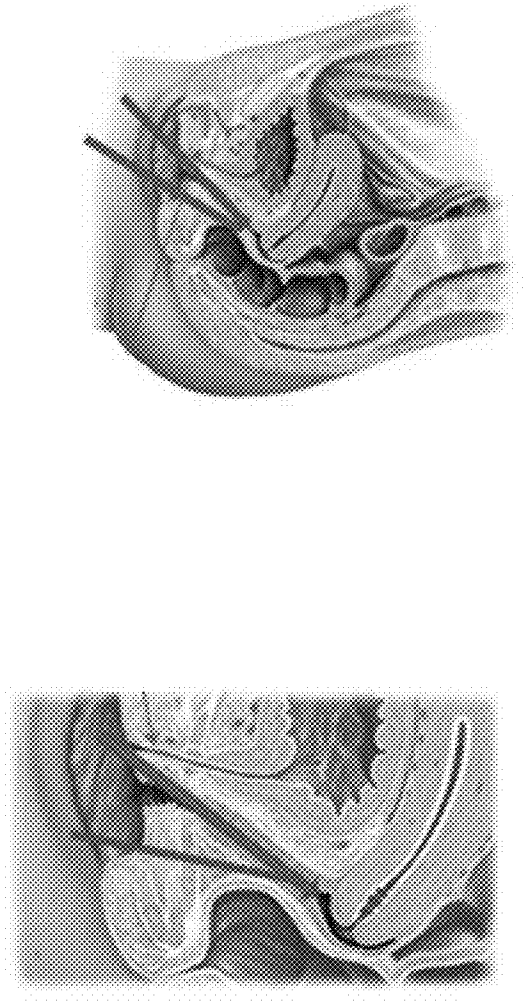
FIG. 8 is a pair of diagrams depicting a known device inserted inside a vagina.
Figure 9:
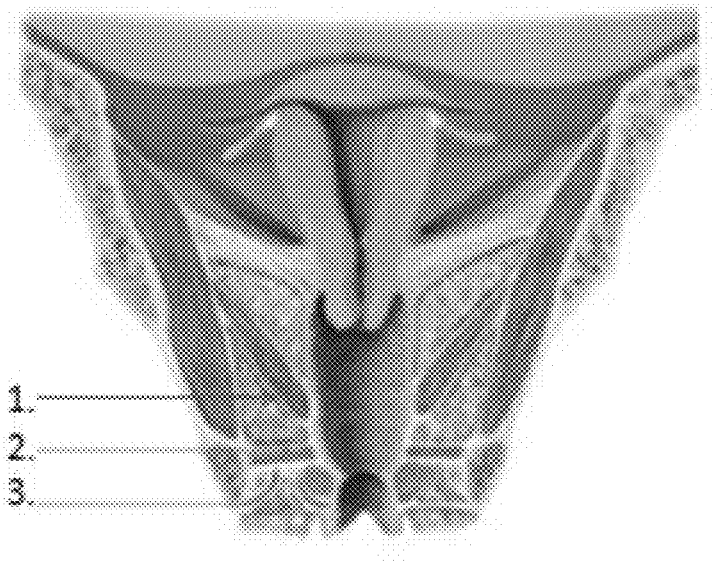
FIG. 9 is a view a pelvic cavity depicting the three layers of pelvic floor musculature.

Referring to FIG. 9, the pelvic floor musculature is divided into three unique layers based upon their depth within the pelvic cavity. These three layers correspond with three distinct resistance axes 20 along the length of the device. This is shown in FIG. 4. The actual resistance is preferably provided by resilient members, not shown, within guide rods 22. A resilient member, here a spring, is shown, but not numbered in FIG. 7. The resilience of the resilient members can vary, and is preferably interchangeable, in accordance with the woman's needs and limitations. Guide rods 22 (including resilient members) are preferably 1.0 to 1.5 cm apart from each other, and can offer symmetrical resistance or graded resistance, depending on the needs of the woman. In addition, the structure of device 10 lends itself to calibrated resistance functionality whereby a user can adjust resistance as desired.

In one method, device 10 is outfitted with the appropriate resistance (via resilient members within guide rods 22), and the user performs a series of muscular contractions. By way of example, she may be instructed to increase endurance by contracting and holding for 10 seconds and repeating 10-20 times. She may be instructed to train fast twitch muscles with single second holds which are repeated 20-100 times/session.

An example of a method to overcome vaginal gapping would be to for a woman to start at a circumference that allows for full contact of the device throughout the vagina and still provides a means of closure. For a specified duration the user performs a set number of contractions. An example of a regimen is 30-100 contractions of one second apiece, for ten times. As discussed above, arm diameter is decreased over time.

A user that can't accept penetration during intimate activities would begin with the smallest overall circumference required so that there is no pain upon insertion. By way of example, the regimen would start at level 1, and the user would perform a set number of contractions, commonly ten seconds, ten times and 30-100 contractions of one second apiece. As she progresses, and penetration is tolerated the device can be adapted to allow a greater circumference. Levels will be increased until penetration during intercourse is comfortable.

An example of a method to heighten orgasm would be for a woman to isolate each specific layer of musculature by contracting/holding/releasing the device, most preferably in a rhythmical fashion.

Generally a regimen would include 10 repetitions of maintaining a 10 second contraction, 100 repetitions of one second contractions, or somewhere between the two. The specific resistance employed would depend on the woman's strength.

It should be understood, of course, that the foregoing relates to exemplary embodiments of the invention and that modifications may be made without departing from the spirit and scope of the invention as set forth in the following claims. By way of example, resilient members can be springs or other resistance providing materials such as gaskets. Also, it is possible to rotate the device for vertical closure exercises. It should also be understood that ranges of values set forth herein inherently include those values, as well as all increments between. Also, "approximately" shall refer to +/−10%.

What is claimed is:

1. A device for strengthening pelvic floor musculature including:

a. Two semi-round arms aligned in parallel;

b. A plurality of resilient members spanning said semi-round arms; and c. A hinged handle pivotally connected to said two semi-round arms, wherein said plurality of resilient members are compressible bringing said arms closer to one another in parallel.

2. The device of claim 1 wherein said two semi-round arms are ovoidal.

3. The device of claim 1 wherein said plurality of resilient members consists of exactly three resilient members.

4. The device of claim 1 wherein said hinged handle includes two semi-round sections, each attached to one of said semi-round arms.

5. The device of claim 1 further comprising a sleeve substantially surrounding said semi-round arms.

6. A method for strengthening pelvic floor musculature including the steps of:

a. Inserting a device for strengthening pelvic floor musculature into a vagina, said device including two semi-round arms aligned in parallel; a plurality of resilient members spanning said semi-round arms; and a hinged handle pivotally connected to said two semi-round arms;

b. Compressing said resilient members, thereby bringing said arms closer one to another; and c. Allowing said resilient members to decompress, thereby allowing distance between said arms to increase, wherein said step of compressing said resilient members includes the step of bringing arms closer one to another in parallel.

7. The method of claim 6 further including the initial step of selecting a device having arms of a desired diameter.

8. The method of claim 6 further including the initial step of attaching said semi-round arms of a desired diameter to said hinged handle.

9. The method of claim 6 further including the initial step of substantially enclosing said arms in a sleeve.

10. The method of claim 9 further including the initial step of selecting a sleeve having a desired diameter.

11. A method for strengthening pelvic floor musculature including the steps of:

a. Selecting a first device having a first diameter, said first device comprising two semi-round arms aligned in parallel, a plurality of resilient members spanning said semi-round arms; and a hinged handle pivotally connected to said semi-round arms, wherein said plurality of resilient members are compressible bringing said arms closer to one another in parallel;

b. Inserting said first device into a vagina;

c. Compressing said first device along its longitudinal axis;

d. Removing said first device;

e. Selecting a second device having a second diameter;

f. Inserting said second device into said vagina;

g. Compressing said second device along its longitudinal axis; and h. Removing said second device.

12. The method of claim 11 wherein said step of selecting a second device includes selecting a second device having a second diameter that is greater than said first diameter.

13. The method of claim 11 wherein said step of selecting a second device includes selecting a second device having a second diameter that is less than said first diameter.

14. The method of claim 11 further comprising the step of evaluating pelvic floor musculature strength, said evaluating step performed before said step of selecting a second device having a second diameter.

15. The method of claim 14 wherein said step of evaluating pelvic floor musculature strength includes consideration of factors selected from changes in back pain intensity, changes in incontinence, changes in frequency of orgasm, changes in intensity of orgasm, changes in pain intensity during intercourse, and combinations thereof.

* * * * *